US008810342B2

(12) United States Patent
Nishimura et al.

(10) Patent No.: US 8,810,342 B2
(45) Date of Patent: Aug. 19, 2014

(54) ELECTROMAGNETIC RELAY

(75) Inventors: Tsukasa Nishimura, Hokkaido (JP); Hirofumi Fukazawa, Hokkaido (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/427,300

(22) Filed: Mar. 22, 2012

(65) Prior Publication Data

US 2012/0242432 A1 Sep. 27, 2012

(30) Foreign Application Priority Data

Mar. 23, 2011 (JP) ..... 2011-063972

(51) Int. Cl.

| | |
|---|---|
| ***H01H 7/04*** | (2006.01) |
| ***H01H 51/22*** | (2006.01) |
| ***H01H 50/02*** | (2006.01) |
| ***H01H 50/14*** | (2006.01) |

(52) U.S. Cl.

CPC ..... *H01H 50/14* (2013.01); *H01H 51/2236* (2013.01); *H01H 50/021* (2013.01)

USPC ..... 335/78; 335/83; 336/107

(58) Field of Classification Search

CPC ..... H01H 50/02; H01H 50/048; H01H 50/14

USPC ..... 335/78–86, 4, 5; 336/107

See application file for complete search history.

(56) References Cited

U.S. PATENT DOCUMENTS

| | | | | |
|---|---|---|---|---|
| 4,692,835 | A | 9/1987 | Setoguti et al. | |
| 5,216,397 | A * | 6/1993 | Matsuoka et al. | 335/83 |
| 6,133,812 | A * | 10/2000 | Magda | 335/4 |
| 6,184,762 | B1 | 2/2001 | Reiss et al. | |
| 2004/0119566 | A1 | 6/2004 | Sanada et al. | |
| 2008/0122564 | A1 | 5/2008 | Utsunomiya et al. | |

FOREIGN PATENT DOCUMENTS

| | | | | |
|---|---|---|---|---|
| CA | 2365551 | C * | 7/2005 | |
| CN | 1499557 | | 5/2004 | |
| CN | 201527937 | | 7/2010 | |
| DE | 3209915 | A1 * | 9/1983 | H01H 45/00 |
| EP | 0243979 | | 11/1987 | |
| JP | 08-077903 | | 3/1996 | |
| JP | 09-219259 | | 8/1997 | |
| KR | 1992-0007272 | | 10/1992 | |
| KR | 10-0627432 | | 6/2004 | |

OTHER PUBLICATIONS

Korea Office action, mail date is Jul. 22, 2013.
Korean Office Action dated Mar. 5, 2014.

* cited by examiner

*Primary Examiner* — Ramon Barrera
(74) *Attorney, Agent, or Firm* — Greenblum & Bernstein, P.L.C.

(57) ABSTRACT

An electromagnetic relay includes a relay body, a connector and an electronic-component connection terminal. The connector is provided integrally with the relay body. The electronic-component connection terminal is disposed so as to protrude from the relay body.

14 Claims, 6 Drawing Sheets

ELECTROMAGNETIC RELAY

BACKGROUND

1. Field of the Invention

The present invention relates to an electromagnetic relay.

2. Description of Related Art

An electromagnetic relay usually includes a bus bar used for a connection with a connector and an electronic component, as shown in FIG. 5. In FIG. 5, an electromagnetic relay 100 is connected to a connector 101 and an electronic component 102 through a bus bar 103. As an example of a technique which uses a bus bar for a connection with a connector or an electronic component, JP-A-8-077903 discloses "Relay Device and Method for Manufacturing the Device." Specifically, a relay device shown in JP-A-8-077903 includes a conductor plate, and one end of the conductor plate is used as connector terminals and connection terminals for circuit elements. JP-A-9-219259 discloses "Connector with Built-in Relay" in which a lead terminal of a relay is formed as a connector terminal, whereby the relay is integrated with the connector.

SUMMARY

As shown in FIG. 6, if a relay body 100 and a connector 101 are integrated with each other, a bus bar is used only for a connection with an electronic component. When a bus bar is used only for the purpose, the resulting configuration is not desirable from the viewpoint of cost. However, when a bus bar is not used, it is impossible to connect an electronic component to the relay.

The present invention was made in view of the above-described circumstances, and an object thereof is to provide an electromagnetic relay in which a relay body is integrated with a connector and which can be connected to an electronic component without using a bus bar.

According to an aspect of the invention, there is provided an electromagnetic relay comprising: a relay body; a connector which is integrated with the relay body; and an electronic-component connection terminal which protrudes from the relay body.

BRIEF DESCRIPTION OF THE DRAWINGS

FIGS. 1A to 1C are external views of an electromagnetic relay according to a first exemplary embodiment of the invention, in which FIG. 1A is a plan view thereof, FIG. 1B is a side view thereof, and FIG. 1C is a rear view thereof;

DETAILED DESCRIPTION

Hereinafter, exemplary embodiments of the invention will be described in detail with reference to the drawings.

Figure 1A:
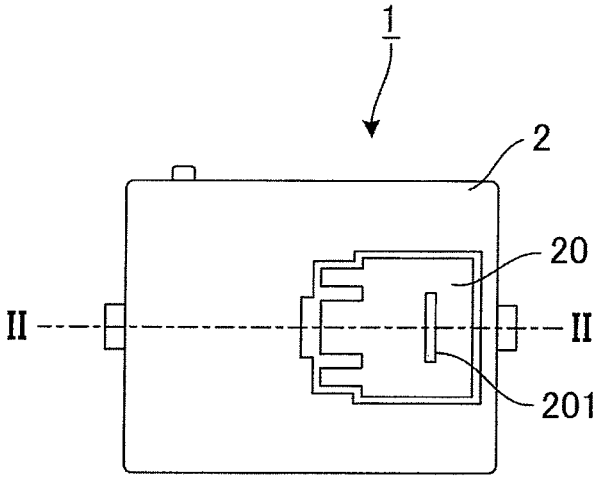
Figure 1B:
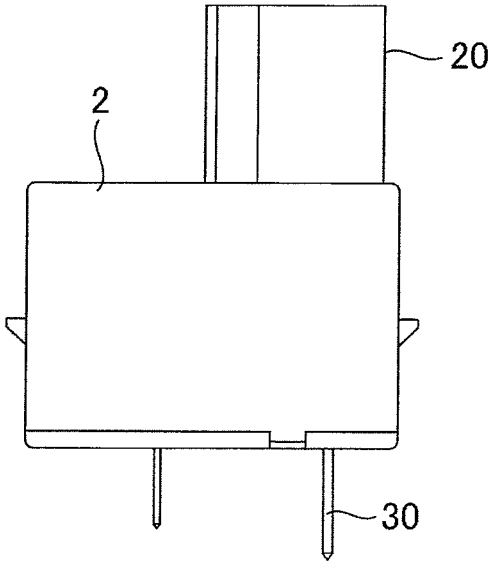
Figure 1C:
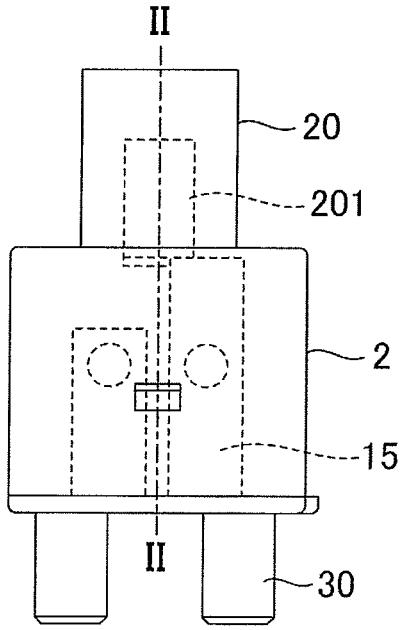

FIGS. 1A to 1C are external views of an electromagnetic relay according to a first exemplary embodiment of the invention. FIG. 1A is a view as seen from the upper side (plan view), FIG. 1B is a view as seen from the lateral side (side view), and FIG. 1C is a view as seen from the rear side (rear view).

Figure 5:
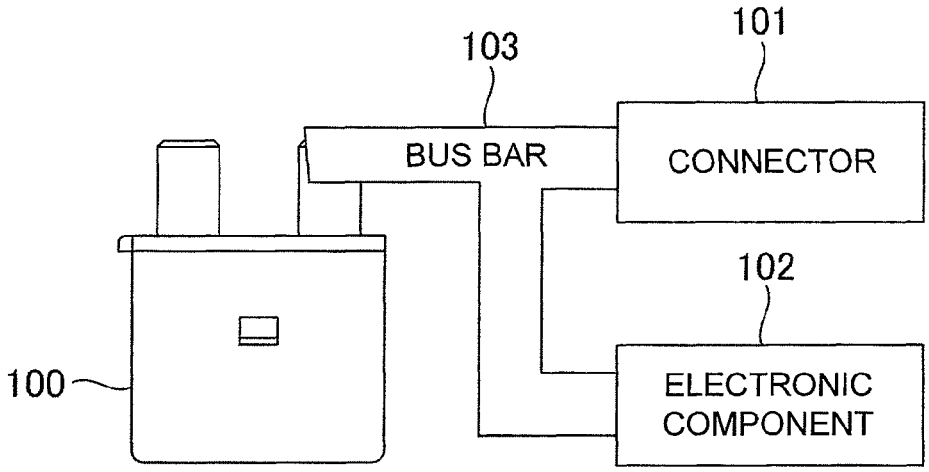
FIG. 5 shows that an electromagnetic relay is connected with a connector and an electronic component via a bus bar.
Figure 6:
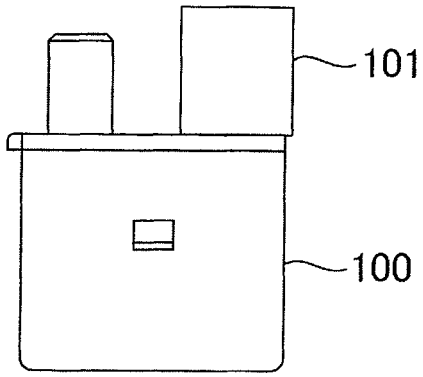
FIG. 6 is external view of a connector integrated electromagnetic relay.

An electromagnetic relay 1 of the exemplary embodiment includes a connector 20 and an electronic-component terminal 30. The connector 20 is provided on and integrated with an upper surface of a relay body 2, thereby integrated with the relay body 2. The electronic-component connection terminal 30 protrudes from a lower surface of the relay body 2. The connector 20 includes one terminal 201. The terminal 201 and the electronic-component connection terminal 30 are connected to a fixed terminal 15 disposed in the relay body 2. The electronic-component connection terminal 30 and the fixed terminal 15 may be configured by a same member or respective separated members. The electronic component 102 (see FIG. 5) is connected to the electronic-component connection terminal 30.

Figure 2:
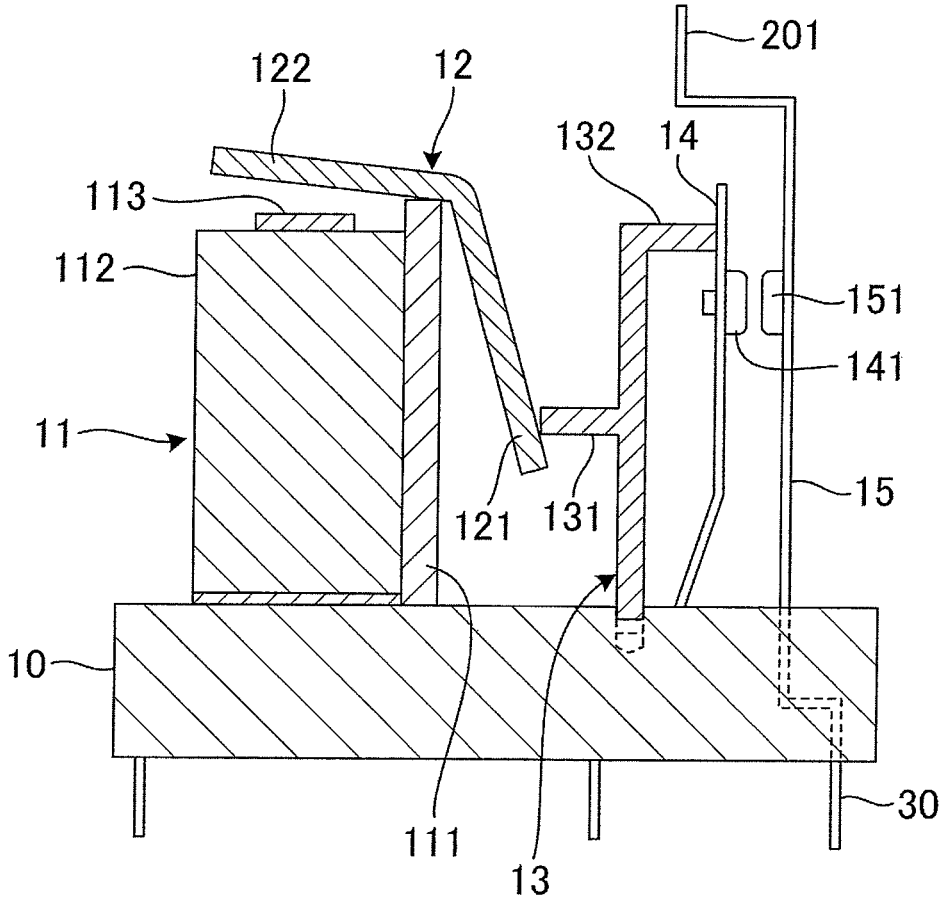
FIG. 2 is a cross-sectional view of the electromagnetic relay taken along a line II-II shown in FIG. 1.

FIG. 2 is a cross-sectional view of the electromagnetic relay 1 taken along line II-II shown in FIG. 1. As shown in FIG. 2, the electromagnetic relay 1 includes a base 10 formed by an insulating member such as a resin. The electromagnetic relay 1 further includes an electromagnet unit 11, an armature 12, a card 13, a movable terminal 14, and a fixed terminal 15, which are disposed in parallel on the base 10.

The electromagnet unit 11 includes a yoke 111 and a coil 112 fixed to the yoke 111. The armature 12 is bent into a substantially dogleg shape, and swingably supported via a hinge spring (not shown) by the upper end edge of the yoke 111 of the electromagnet unit 11. The card 13 is supported by the base 10 so as to be swingable toward the armature 12 and the movable terminal 14. The card 13 has a first branch portion 131 which contacts the armature 12, and a second branch portion 132 which contacts the movable terminal 14. The movable terminal 14 is placed so as to oppose the card 13, and an upper end portion thereof contacts the second branch portion 132 of the card 13. In the movable terminal 14, a movable contact 141 is disposed below a position at which the movable terminal 14 contacts the second branch portion 132 of the card 13. The fixed terminal 15 is placed so as to oppose the movable terminal 14, and an upper end portion thereof is formed into an L-shape. A part of the L-shaped portion, which extends in a vertical direction, corresponds to the terminal 201 of the connector 20.

In the electromagnetic relay 1, when no voltage is applied to the electromagnet unit 11, a portion of the armature in the vicinity of a lower end portion 121 is urged by the spring force of the hinge spring (not shown). Therefore, an attractable surface of the upper end portion 122 of the armature 12 is separated from a magnetic pole portion 113 of the electromagnet unit 11. Since the attractable surface of the upper end portion 122 of the armature 12 is separated from the magnetic pole portion 113 of the electromagnet unit 11, the card 13 is in a resting state, and the movable contact 141 of the movable terminal 14 and a fixed contact 151 of the fixed terminal 15 are in a separated state. When a voltage is applied to the electromagnet unit 11 in this state, the electromagnet unit 11 is in an energized state, and the attractable surface of the upper end portion 122 of the armature 12 is attracted to the electromagnet unit 11. Then, the swinging operation of the armature 12 at this time causes the card 13 to swing toward the movable terminal 14, so that the movable contact 141 of the movable terminal 14 contacts the fixed contact 151 of the fixed terminal 15, whereby the movable terminal 14 and the fixed terminal 15 are in a current conducting state.

In the state in which the voltage is applied to the electromagnet unit 11, when the voltage application is stopped, the electromagnet unit 11 is in a de-energized state, and the attracted force of the armature 12 to the electromagnet unit 11 is released. When the attracted force of the armature 12 is released, a part of the armature 12 in the vicinity of the lower end portion 121 is urged by the spring force of the hinge spring (not shown), and the armature 12 swings in the direction opposite to that in the case in which the voltage is applied. The swinging operation of the armature 12 at this time causes the card 13 to swing toward the armature 12, so that the movable contact 141 of the movable terminal 14 is separated from the fixed contact 151 of the fixed terminal 15, whereby the movable terminal 14 and the fixed terminal 15 are in a current non-conducting state.

As described above, according to the electromagnetic relay 1 of the first exemplary embodiment, the connector 20 is provided so as to be integrated with the relay body 2, and the electronic-component connection terminal 30 is disposed so as to protrude from the relay body 2. Therefore, the relay body 2 and the connector 20 can be integrated with each other, and an electronic component can be connected to the electromagnetic relay 1 without using a bus bar.

Figure 3:
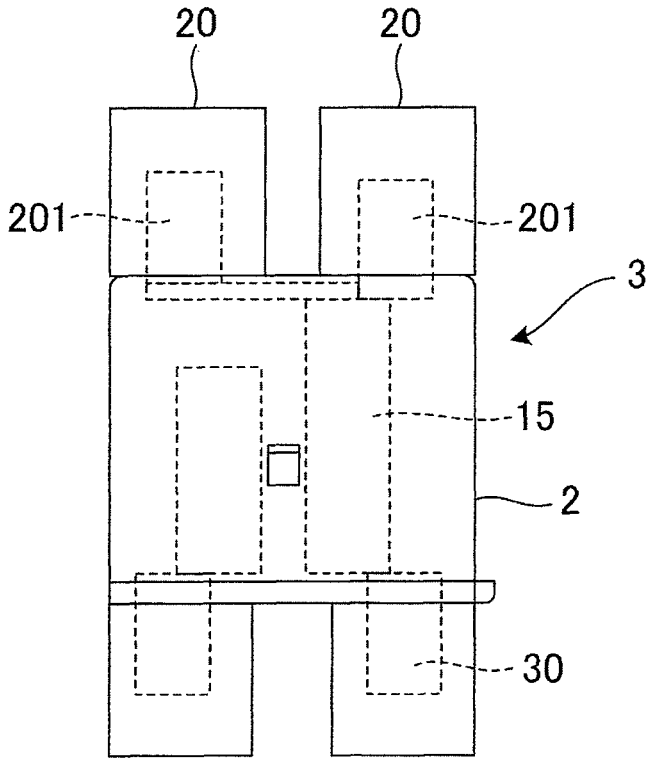
FIG. 3 is a rear view of an electromagnetic relay according to a second exemplary embodiment of the invention.
Figure 4:
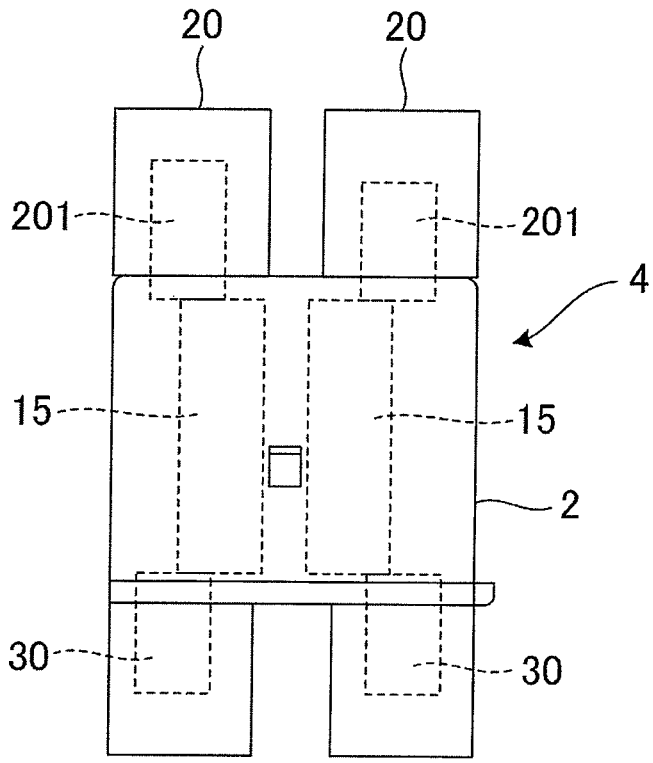
FIG. 4 is a rear view of an electromagnetic relay according to a third exemplary embodiment of the invention.

In the electromagnetic relay 1 of the exemplary embodiment, one connector 20 is disposed. Alternatively, a plurality of connectors may be provided integrally with the relay body 2. Furthermore, the electronic-component connection terminal 30 may be disposed for each of a plurality of fixed terminals 15. The number of the electronic-component connection terminal 30 is not limited to one, and it is a matter of course that a plurality of electronic-component connection terminals may be disposed. FIG. 3 is a rear view (as seen from the rear side) of an electromagnetic relay 3 of the electromagnetic relay 3 according to a second exemplary embodiment. In the second exemplary embodiment, two connectors 20 are integrated with the relay body 2, and the terminals 201 of the two connectors 20 are connected to the fixed terminal 15. FIG. 4 is a rear view (as seen from the rear side) of an electromagnetic relay 4 of the electromagnetic relay 1 according to the third exemplary embodiment. In the third exemplary embodiment, two connectors 20 are integrated with the relay body 2, and two electronic-component connection terminals 30 are disposed. In the exemplary embodiment, the terminals 201 of the connectors 20, and the electronic-component connection terminals 30 are connected to two fixed terminals 15, respectively.

Further, as shown in FIG. 4, one or more connectors and one or more electronic-component connection terminals, a total number of which is a maximum of four, may be provided integrally with the relay body, by routing of a main terminal (i.e. fixed terminal 15).

According to the exemplary embodiments of the invention, the connector is integrated with the relay body, and the electronic-component connection terminal protrudes from the relay body. Therefore, the relay body and the connector can be integrated with each other, and an electronic component can be connected to the relay without using a bus bar.

What is claimed is:

1. An electromagnetic relay comprising:

a relay body;

a connector that includes a terminal and an outer wall portion, the terminal protruding from an upper surface of the relay body to a top end thereof, the outer wall portion protruding from the upper surface of the relay body to surround the terminal and having an opening at a top end thereof, the top end of the outer wall portion protruding beyond the top end of the terminal; and an electronic-component connection terminal which protrudes from a lower surface of the relay body and is connectable to an electronic component, wherein a fixed terminal disposed in the relay body connects the terminal with the electronic-component connection terminal.

2. The electromagnetic relay according to claim 1, wherein the relay body integrally includes a plurality of connectors and a plurality of electronic-component connection terminals.

3. The electromagnetic relay according to claim 1, wherein the relay body comprises:

a base comprising an upper surface and a lower surface opposite to the upper surface;

an electromagnet unit which is provided on the upper surface of the base and which comprises a yoke and a coil fixed to the yoke;

an armature swingably supported by the yoke;

a card which is provided on the upper surface of the base so as to be swingable and which comprises a first branch portion contacting the armature and a second branch portion;

a movable terminal provided on the upper surface of the base so as to contact the second branch portion of the card; and a fixed terminal which opposes the movable terminal and which comprises an upper end and a lower end opposite to the upper end, wherein the upper end of the fixed terminal is connected to a connection terminal of the connector, and the lower end of the fixed terminal is connected to the electronic-component connection terminal, and wherein the electronic-component connection terminal protrudes from the lower surface of the base.

4. The electromagnetic relay according to claim 2, wherein the plurality of connectors is four connectors and the plurality of electronic-component connection terminals is four electronic-component connection terminals.

5. The electromagnetic relay according to claim 3, wherein in a current no conducting state, the armature is urged away from a magnetic pole of the electromagnetic unit, the armature contacts the first branch of the card, the second branch of the card contacts the movable terminal, and the movable terminal is spaced from the fixed terminal.

6. The electromagnetic relay according to claim 3, wherein in a current conducting state, the armature is urged toward a magnetic pole of the electromagnetic unit to contact the magnetic pole, the armature contacts the first branch of the card, the second branch of the card contacts the movable terminal, and the movable terminal contacts the fixed terminal.

7. The electromagnetic relay according to claim 1, wherein the connector comprises a connection terminal.

8. The electromagnetic relay according to claim 7, wherein the relay body comprises:

a base comprising an upper surface and a lower surface opposite to the upper surface, wherein the electronic-component connection terminal protrudes from the lower surface of the base.

9. The electromagnetic relay according to claim 8, wherein the relay body further comprises:

an electromagnet unit which is provided on the upper surface of the base and which comprises a yoke and a coil fixed to the yoke; and an armature swingably supported by the yoke.

10. The electromagnetic relay according to claim 9, wherein the relay body further comprises:

a card which is provided on the upper surface of the base so as to be swingable and which comprises a first branch portion contacting the armature and a second branch portion;

a movable terminal provided on the upper surface of the base so as to contact the second branch portion of the card; and a fixed terminal which opposes the movable terminal and which comprises an upper end and a lower end opposite to the upper end, wherein the upper end of the fixed terminal is connected to the connection terminal of the connector, and the lower end of the fixed terminal is connected to the electronic-component connection terminal.

11. The electromagnetic relay according to claim 10, wherein in a current no conducting state, the armature is urged away from a magnetic pole of the electromagnetic unit, the armature contacts the first branch of the card, the second branch of the card contacts the movable terminal, and the movable terminal is spaced from the fixed terminal.

12. The electromagnetic relay according to claim 10, wherein in a current conducting state, the armature is urged toward a magnetic pole of the electromagnetic unit to contact the magnetic pole, the armature contacts the first branch of the card, the second branch of the card contacts the movable terminal, and the movable terminal contacts the fixed terminal.

13. The electromagnetic relay according to claim 1, wherein the electronic-component connection terminal extends from the lower surface of the relay body in a direction opposite of the extending direction of the terminal.

14. An electromagnetic relay comprising:

a relay body;

a connector having a connection terminal, the connector including an outer wall portion, having an opening at a top end thereof, that extends from an upper surface of the relay body to surround the connection terminal; and an electronic-component connection terminal which protrudes from the relay body, wherein the relay body comprises:

a base comprising an upper surface and a lower surface opposite to the upper surface;

an electromagnet unit which is provided on the upper surface of the base and which comprises a yoke and a coil fixed to the yoke;

an armature swingably supported by the yoke;

a card which is provided on the upper surface of the base so as to be swingable and which comprises a first branch portion contacting the armature and a second branch portion;

a movable terminal provided on the upper surface of the base so as to contact the second branch portion of the card; and a fixed terminal which opposes the movable terminal and which comprises an upper end and a lower end opposite to the upper end, wherein the upper end of the fixed terminal is connected to the connection terminal of the connector, and the lower end of the fixed terminal is connected to the electronic-component connection terminal, and wherein the electronic-component connection terminal protrudes from the lower surface of the base.

* * * * *